US010364129B2

(12) United States Patent
Landsbeck et al.

(10) Patent No.: US 10,364,129 B2
(45) Date of Patent: Jul. 30, 2019

(54) TRANSPORTING APPARATUS, IN PARTICULAR ESCALATOR OR MOVING WALKWAY

(71) Applicants: THYSSENKRUPP ELEVATOR AG, Essen (DE); thyssenkrupp AG, Essen (DE)

(72) Inventors: Patrick Landsbeck, Kelsterbach (DE); Covadonga Fernández González, Gijon-Asturias (ES); Reinhardt Krämer, Hamburg (DE)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 15/745,785

(22) PCT Filed: Jul. 22, 2016

(86) PCT No.: PCT/EP2016/067509
§ 371 (c)(1),
(2) Date: Jan. 18, 2018

(87) PCT Pub. No.: WO2017/017005
PCT Pub. Date: Feb. 2, 2017

(65) Prior Publication Data

US 2018/0208440 A1 Jul. 26, 2018

(30) Foreign Application Priority Data

Jul. 24, 2015 (DE) ..... 10 2015 214 077

(51) Int. Cl.
*B66B 23/00* (2006.01)
*B66B 29/00* (2006.01)
(Continued)

(52) U.S. Cl.
CPC ..... *B66B 23/00* (2013.01); *B66B 21/04* (2013.01); *B66B 29/00* (2013.01); *B66B 21/10* (2013.01)

(58) Field of Classification Search
None
See application file for complete search history.

(56) References Cited

U.S. PATENT DOCUMENTS 6,129,198 A * 10/2000 Nusime ..... B66B 23/00 198/321
6,637,580 B1 * 10/2003 Sneed ..... B65G 21/00 198/326
(Continued)

FOREIGN PATENT DOCUMENTS

CN 1830747 A 9/2006
EP 0963941 A 12/1999
(Continued)

OTHER PUBLICATIONS

English Translation of International Search Report issued in PCT/EP2016/067509, dated Aug. 31, 2016 (dated Sep. 13, 2016).

*Primary Examiner* — William R Harp
(74) *Attorney, Agent, or Firm* — Thyssenkrupp North America, Inc.

(57) ABSTRACT

A transporting apparatus such as an escalator or a moving walkway may include a truss. A first support angle may be disposed at a first end of the truss, and a second support angle may be disposed at a second end of the truss. The first support angle may be fitted on a building via a fixed bearing. The first support angle may have a hole, and a first fixing element fastened on the building may pass through the hole. The second support angle may be fitted on the building via
(Continued)

a floating bearing. The second support angle may have a slot, and a second fixing element fastened on the building may pass through the slot.

15 Claims, 6 Drawing Sheets

(51) Int. Cl.
*B66B 21/04* (2006.01)
*B66B 21/10* (2006.01)

(56) References Cited

U.S. PATENT DOCUMENTS

| | | | | |
|---|---|---|---|---|
| 9,254,986 | B2 * | 2/2016 | Inoue | B66B 21/02 |
| 9,834,416 | B2 * | 12/2017 | Krampl | B66B 23/00 |
| 10,046,950 | B2 * | 8/2018 | Nawata | B66B 21/02 |
| 2003/0102198 | A1 * | 6/2003 | Nusime | B66B 21/00 198/321 |
| 2018/0354755 | A1 * | 12/2018 | Mori | B66B 25/00 |

FOREIGN PATENT DOCUMENTS

| | | | |
|---|---|---|---|
| JP | S4935113 | Y | 9/1974 |
| JP | S526389 | U | 6/1975 |
| JP | H0958956 | A | 3/1997 |
| JP | 2011063389 | A | 3/2011 |
| JP | 2012086939 | A | 5/2012 |
| JP | 2013241227 | A | 12/2013 |
| WO | 0210054 | A | 2/2002 |
| WO | 2015082195 | A | 6/2015 |

* cited by examiner

TRANSPORTING APPARATUS, IN PARTICULAR ESCALATOR OR MOVING WALKWAY

CROSS REFERENCE TO RELATED APPLICATIONS

This application is a U.S. National Stage Entry of International Patent Application Serial Number PCT/EP2016/067509, filed Jul. 22, 2016, which claims priority to German Patent Application No. DE 10 2015 214 077.6, filed Jul. 24, 2015, the entire contents of both of which are incorporated herein by reference.

FIELD The present disclosure generally relates to transporting apparatuses and methods for installing transporting apparatuses in buildings, including escalators and moving walkways that have a truss.

BACKGROUND

Transporting apparatus, in particular escalators or walkways, usually comprise a conveyor belt in the form of a stepped belt or transporting belt. This conveyor belt is usually arranged inside the truss or frame of the transporting apparatus. This truss usually comprises elements for arranging the transporting apparatus in a building.

In the case of natural disasters such as e.g. earthquakes or hurricanes, it is of great importance that the transporting apparatus is arranged securely in the building so that damage to the transporting apparatus from the natural disaster, or a collapse of the transporting apparatus, can be prevented.

WO 02/10054 A discloses for example an earthquake-secure bearing for escalators or walkways. Bearings are provided here for building-side mounting of a truss at the escalator ends or walkway ends.

JP 09058956 describes an upper bearing for an escalator which is secured against longitudinal movements which may be triggered by earthquakes.

Thus a need exists for a transporting apparatus that is arranged securely in a building so that the apparatus and the building are protected against damage from natural disasters.

DETAILED DESCRIPTION

Figure 1:
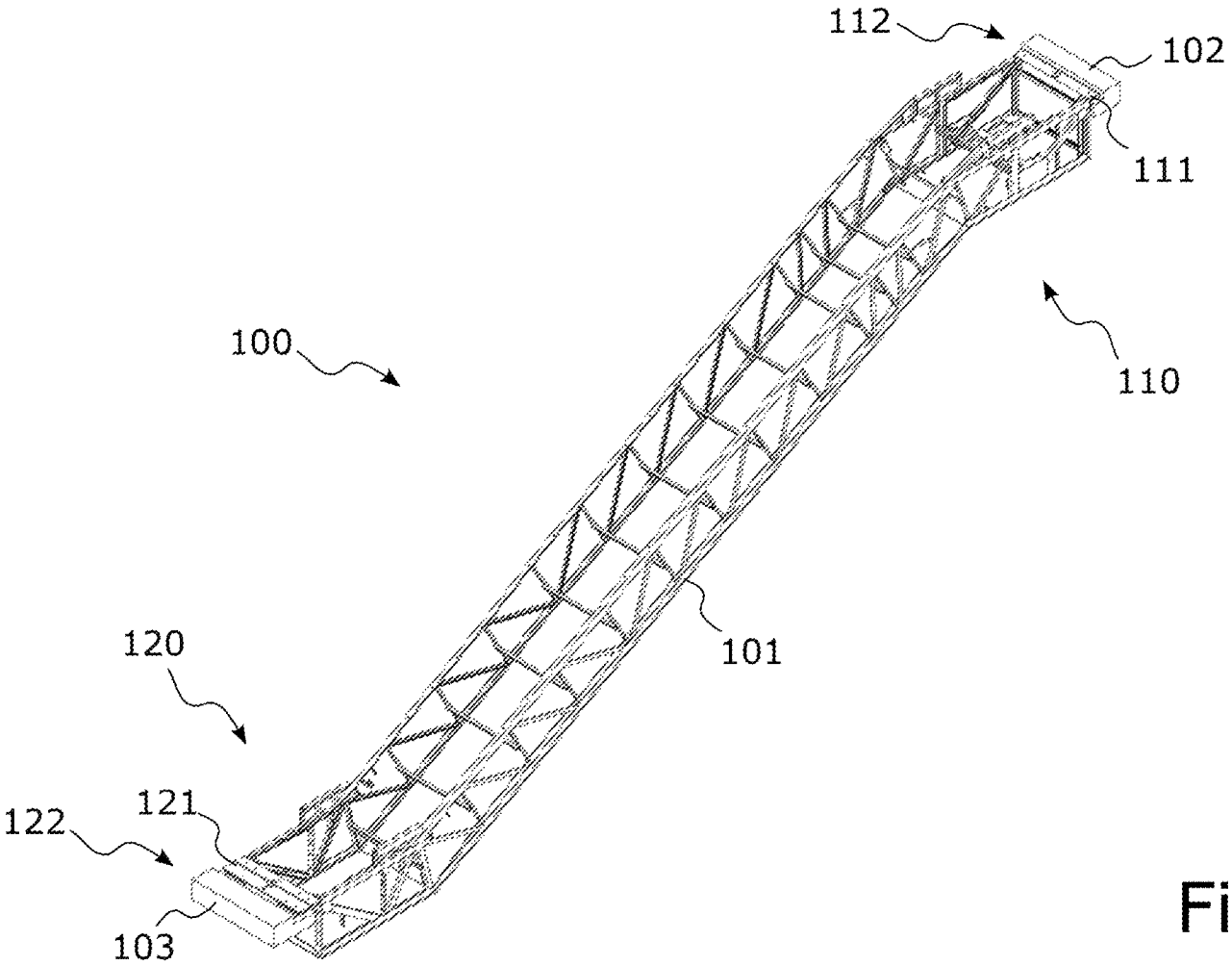
FIG. 1 is a diagrammatic perspective view of part of an example transporting apparatus configured as an escalator.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The transporting apparatus is in particular configured as an escalator or a moving walkway, furthermore in particular as a person-transporting apparatus. A first support angle is fitted at a first end of a truss or frame of the transporting apparatus. A second support angle is fitted at a second end of the truss. The support angles are in particular provided for mounting the truss on a building.

The first support angle is fitted on the building via a fixed bearing. The first support angle has a hole. A first fixing element fastened on the building passes through the hole. The second support angle is fitted on the building via a floating bearing. The second support angle has a slot. A second fixing element fastened on the building passes through the slot. The main extension direction of the slot in particular runs parallel to the main extension direction of the transporting apparatus.

In particular, a suitable bearing is provided on the building, on which the respective support angle is fitted. These bearings may be made for example of concrete, hard wood and/or hard rubber. The first or the second fixing element is in particular fastened to the respective bearing.

The transporting apparatus in particular has a conveyor belt, in particular an endlessly circulating, movable conveyor belt. In the case of an escalator, the conveyor belt is in particular configured as a stepped belt, and in the case of a moving walkway, in particular as a transporting belt. The transporting apparatus may have further suitable elements, for example a balustrade, handrails, drives for moving the conveyor belt and the handrails, shafts, gears, gearwheels, chains, rails etc.

The truss in particular constitutes a supporting structure in which various elements of the transporting apparatus are arranged, for example the conveyor belt and elements for its movement. The truss is for example formed as a lattice structure and assembled from a plurality of longitudinal, vertical and/or diagonal beams or bars which may be made of metal, e.g. steel.

The first support angle is mounted on the building via the fixed bearing, in particular such that a translational movement of the first support angle in all three spatial directions is suppressed, and that a rotational movement, in particular about a vertical axis or a main extension direction of the building, is possible.

The second support angle is mounted on the building via the floating bearing, in particular such that a translational movement of the second support angle in one of the three spatial directions is possible, at least to a certain extent. In particular, a translational movement in the main extension direction of the transporting apparatus, or in a movement direction of the conveyor belt, is possible thanks to the floating bearing. Translational movements perpendicular to this main extension direction of the transporting apparatus are in particular suppressed. The floating bearing also in particular allows a rotational movement about the main extension direction of the building.

The transporting apparatus is secured against damage from natural disasters such as earthquakes or hurricanes. The transporting apparatus is particularly suitable for use in buildings in regions at risk of earthquake, or in regions with strong seismic activity, and is protected against damage from earthquakes or seismic activity. During such natural disasters, high forces, loads and accelerations act on the transporting apparatus. The fixed bearing guarantees that the transporting apparatus is not undesirably set in a translational movement due to the forces occurring in a natural disaster. Since both bearings allow rotational movements at least about the main extension direction of the building, and since the floating bearing allows a translational movement in one of the three spatial directions, the transporting apparatus may, at least to a degree, yield under and compensate for the forces occurring. This prevents stresses acting in particular in the truss due to the forces occurring in the transporting apparatus, and prevents the transporting apparatus, in particular its truss, from being damaged. In particular, breakage of individual beams or bars of the truss is prevented. The transporting apparatus is also prevented from collapsing in the building in the event of a natural disaster.

According to an advantageous embodiment, a first locking element is arranged on the first fixing element. Alternatively or additionally, a second locking element is arranged on the second fixing element. Such locking elements in particular secure the respective support angle against displacement in the vertical direction. In particular, in this way a translational movement of the transporting apparatus in the vertical direction or in the main extension direction of the building may be suppressed. The locking elements are in particular each fitted at an upper end of the respective fixing element which protrudes from the respective support angle.

In particular, the first and/or the second locking element is made of the same material as the respective fixing element. In particular, on natural disasters, the first and/or second locking element can prevent the transporting apparatus from "jumping" or being moved out of the support angles by the forces occurring on a natural disaster, and thus collapsing in the building.

Preferably, the first locking element and/or the second locking element are each formed as a disc, for example a round, square or rectangular disc, as a nut, a lock ring or a split pin. According to a preferred embodiment, the first locking element is formed as a first disc, the width of which is greater than the width of the hole of the first support angle. Alternatively or additionally, the second locking element is formed as a second disc, the width of which is greater than the width of the slot.

Preferably, the first locking element and the first fixing element, and/or the second locking element and the second fixing element, each form a structural unit. The respective locking element and the respective fixing element are in particular formed as one structural element.

Preferably, the respective locking element and the respective fixing element are formed as separate elements. Preferably, the first locking element is fitted on the first fixing element, and/or the second locking element is fitted on the second fixing element. For example, the respective locking element may be screwed or pushed onto the respective fixing element. In particular, the respective locking element in the form of a nut may be screwed onto the respective fixing element, or in the form of a plate, pushed thereon.

Advantageously, the first fixing element and/or the second fixing element are each formed as a peg, pin or bolt and/or threaded bolt. In particular, a thread or dowel may be provided in the bearing of the building in order to secure the fixing element configured as a threaded bolt. The fixing element may also be secured on the bearing of the building by force fit.

Preferably, the first fixing element and the second fixing element are formed so as to be substantially cylindrical. Alternatively or additionally, the hole of the first support angle is formed so as to be substantially circular. Preferably, the hole of the first support angle has the same diameter as the first fixing element, or substantially the same diameter as the first fixing element. In particular, the diameter of the hole is only insignificantly larger than the diameter of the first fixing element, for example larger by a maximum of 0.25%, 0.5%, 1% or 5% than the diameter of the first fixing element. The first fixing element can thus easily be passed through the hole.

Preferably, the width of the slot corresponds to the diameter of the second fixing element, or substantially to the diameter of the second fixing element. In particular, the width of the slot is only insignificantly larger than the diameter of the second fixing element, for example larger by a maximum of 0.25%, 0.5%, 1% or 5% than the diameter of the second fixing element. Thus the second fixing element can also be easily passed through the slot.

Preferably, the length of the slot is between 100 mm and 350 mm longer than the diameter of the second fixing element. The length of the slot is thus dimensioned such that a translational movement of the second support angle is possible in a range between ±50 mm and ±175 mm, in particular if the second fixing element is arranged substantially in the middle of the slot relative to the length of the slot. Particularly preferably, the length of the slot is between 140 mm and 280 mm longer than the diameter of the second fixing element. Thus a translational movement of the second support angle is possible in a range between ±70 mm and ±140 mm, in particular when the second fixing element is arranged substantially centrally in the slot relative to its length.

Advantageously, the first support angle is fitted at an upper end of the truss, and the second support angle is fitted at a lower end of the truss. The transporting apparatus can thus be fitted in particular on an upper floor of the building via the fixed bearing, and in particular on a lower floor of the building via the floating bearing.

In addition to the transporting apparatus, the invention furthermore concerns a method for installation of a transporting apparatus in a building. Embodiments of this method according to the invention arise correspondingly from the description above of the transporting apparatus according to the invention.

To install the transporting apparatus, this is arranged at the desired position in the building, e.g. between two floors. The first fixing element is passed through the hole in the first support angle and fastened to the building, and the second fixing element is passed through the slot in the second support angle and fastened to the building.

Preferably, the first support angle is fitted on an upper floor of the building via the fixed bearing, and the second support angle is fitted on a lower floor of the building via the floating bearing.

Further advantages and embodiments of the invention arise from the description and the attached drawing.

It is understood that the features cited above and explained below may be used not only in the combination given but in any other combinations or alone without leaving the scope of the present invention.

FIG. 1 shows diagrammatically a part of a preferred embodiment of a transporting apparatus according to the invention, designated 100. In this example, the transporting apparatus 100 is configured as an escalator.

The escalator 100 has a truss 101. This truss 101 is for example formed as a lattice structure from a plurality of e.g. longitudinally oriented, vertical and/or diagonal beams.

This truss 101 may contain various elements of the escalator 100 which are not shown in FIG. 1 for the sake of clarity. For example, a conveyor belt in the form of a stepped belt, and elements for its movement, may be arranged in the truss 101.

The escalator 100 may contain further elements which are not shown in FIG. 1 for the sake of clarity: for example handrails, drives for moving the handrails, shafts, gears, gearwheels, chains, further rails etc.

The truss 101 has a first or upper end 110, and a second or lower end 120. Elements are provided at the ends 110 and 120 for fitting the escalator 100 on a building. FIG. 1 shows a first bearing 102 and a second bearing 103 of this building. These bearings are in particular connected fixedly to the bearing, or are formed as part of the building. The escalator 100 is fitted on these bearings 102 and 103 and thus on the building. The bearings 102 and 103 are formed for example from concrete.

A first or upper support angle 111 is fitted on the truss 101 at the upper end 110. This first support angle 111 is fitted on the first bearing 102 via a fixed bearing 112. A second or lower support angle 121 is fitted at the second end 120 of the truss 101. This second support angle 121 is fitted on the second bearing 103 via a floating bearing 122.

The ends 110 and 120 are shown in more detail in FIGS. 2 to 7, and are explained below with reference to these figures. Identical reference symbols in FIGS. 1 to 7 designate the same or similar elements.

Figure 2:
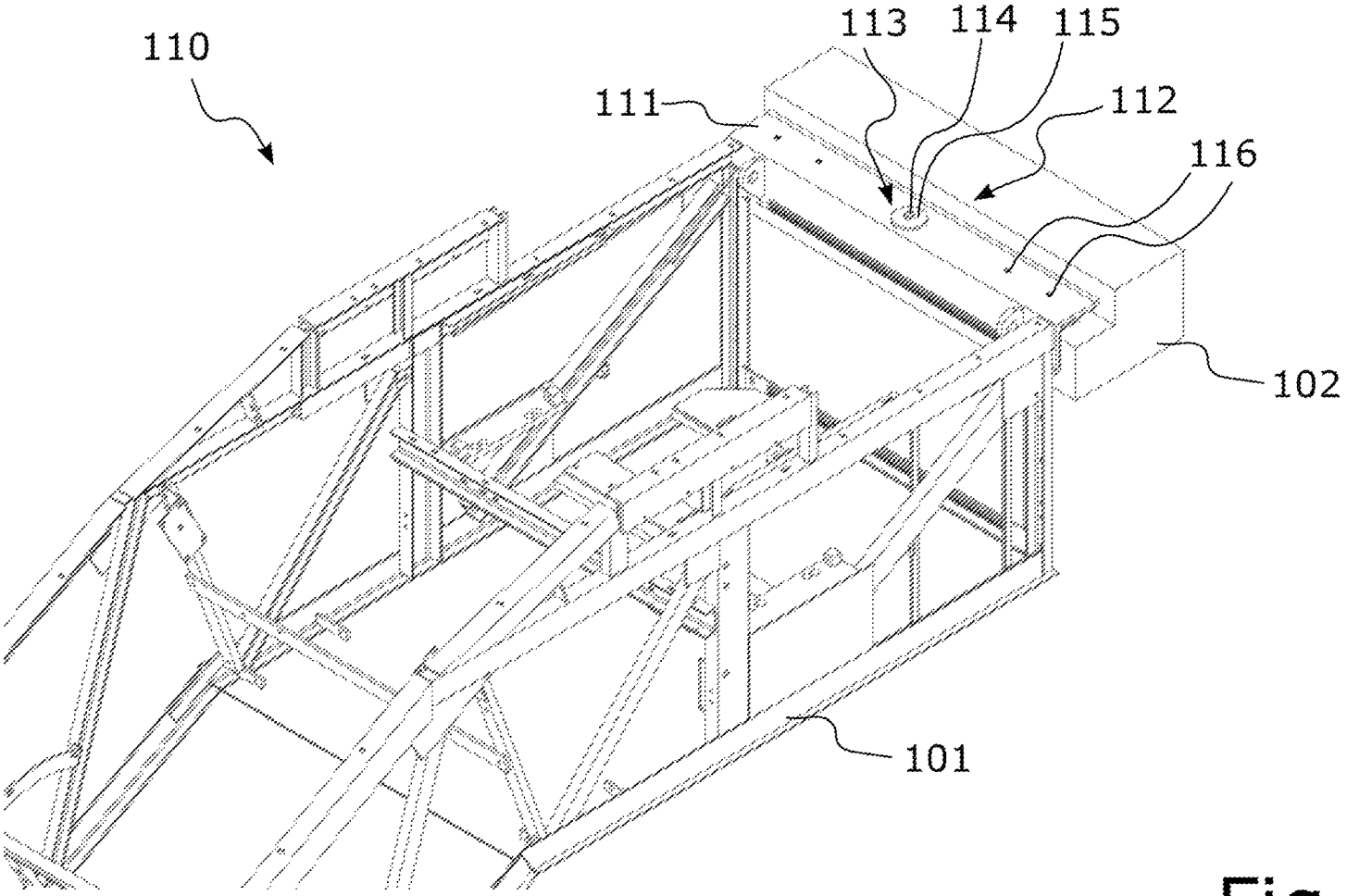
FIG. 2 is a diagrammatic perspective view of an upper end of a truss of the example transporting apparatus of FIG. 1.
Figure 3:
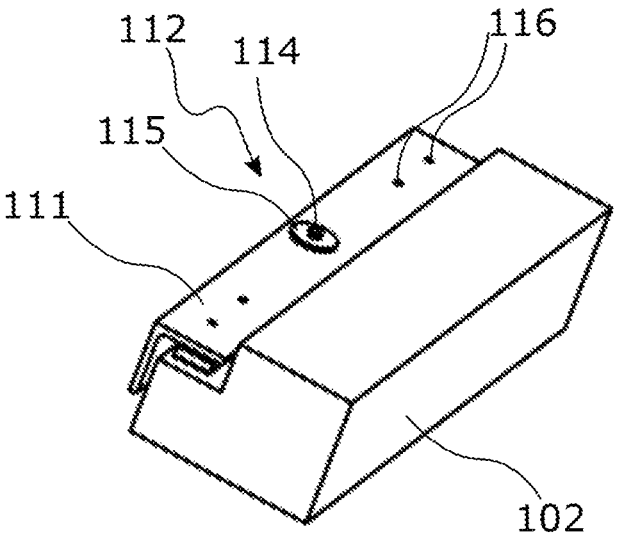
FIG. 3 is a diagrammatic perspective view of an example fixed bearing, an example first support angle, and an example first bearing of an example transporting apparatus.
Figure 4:
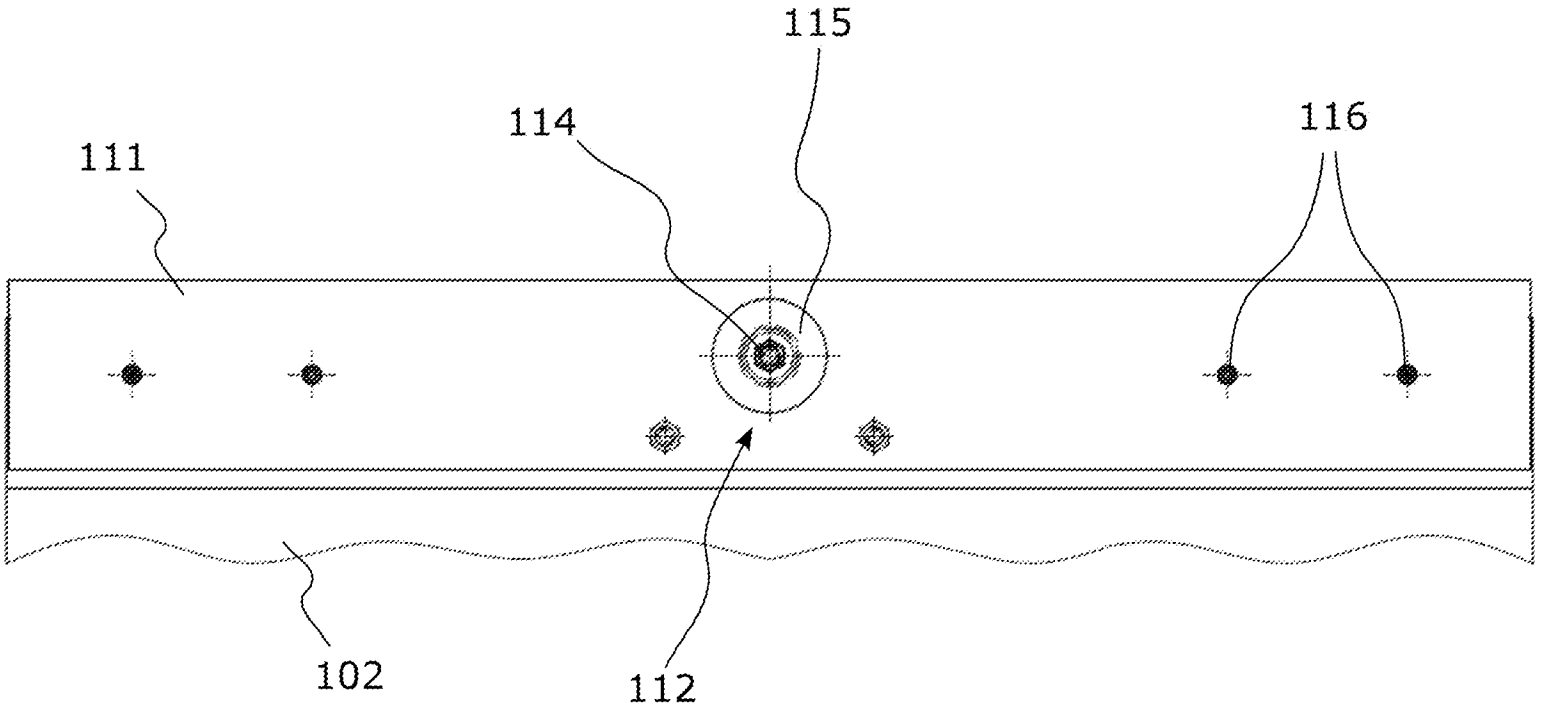
FIG. 4 is a diagrammatic top view of the example fixed bearing of FIG. 3.

The upper end 110 of the truss 101 is shown diagrammatically in a perspective view in FIGS. 2 and 3, and in a diagrammatic top view in FIG. 4. The first support angle 111 may be fixedly connected to the truss 101, and the support angle 111 and the truss 101 may form a common structural unit. The first support angle 111 and the truss 101 may however also be separate elements, wherein the first support angle 111 may for example be bolted to the truss 101.

For the fixed bearing 112, the first support angle 111 has a hole 113. A first fixing element 114 is introduced into this hole 113, or the first fixing element 114 passes through the hole 113. In this example, the first fixing element 114 is formed as a pin or peg. The pin 114 is connected by force fit to the first bearing 102. A first locking element 115 is fitted on the pin 114. The first locking element 115 is in particular formed as a first disc which is for example screwed onto the pin 114.

The diameter of the hole 113 substantially corresponds to the diameter of the pin 114. For example, the hole 113 may be larger by maximum 0.5% than the diameter of the pin 114. The pin 114 can thus pass easily through the hole 113.

As depicted in FIGS. 2 to 4, the first support angle 111 lies on the elements 116 which are fixedly connected to the first bearing 102. These elements 116 are for example formed as threaded bolts which are screwed into the first bearing 102.

The fixed bearing 112 prevents a translational movement of the first support angle 111 relative to the bearing 102. A rotational movement of the first support angle 111 and hence of the truss 101 about the pin 114 is however possible within the limits defined e.g. by the first bearing 102.

Figure 6:
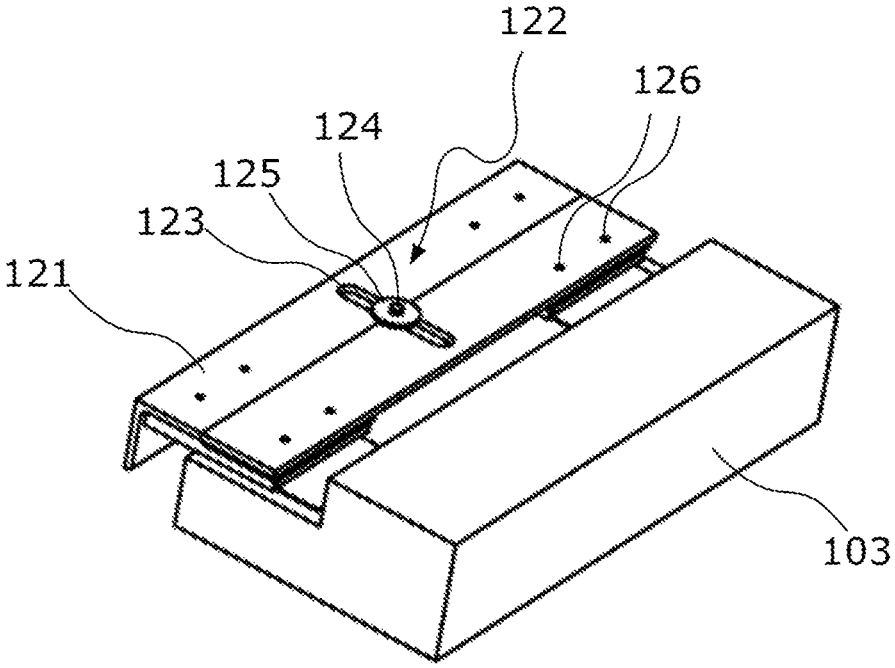
FIG. 6 is a diagrammatic perspective view of an example float bearing, an example second support angle, and an example second bearing of an example transporting apparatus.
Figure 5:
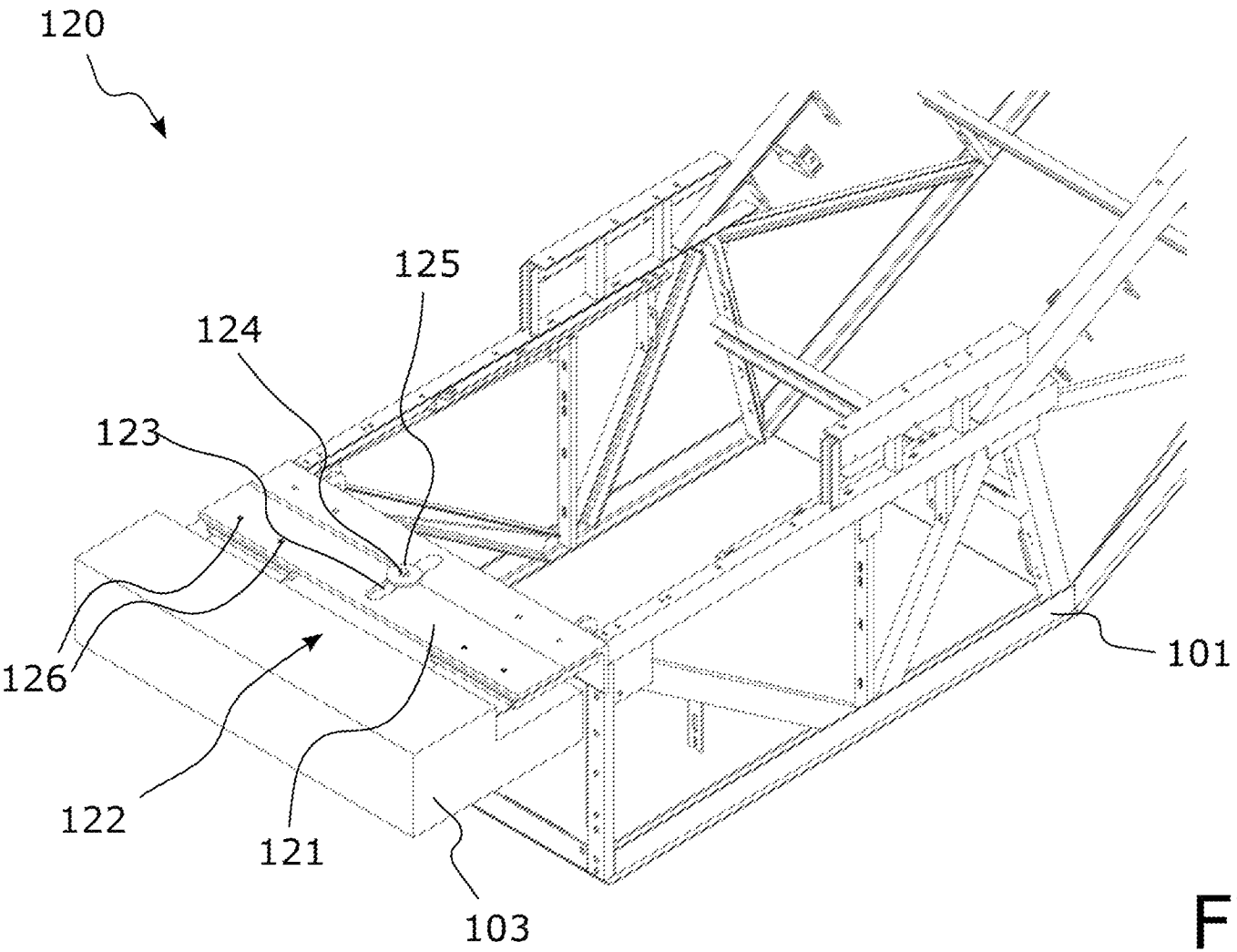
FIG. 5 is a diagrammatic perspective view of an example lower end of a truss of an example transporting apparatus.
Figure 7:
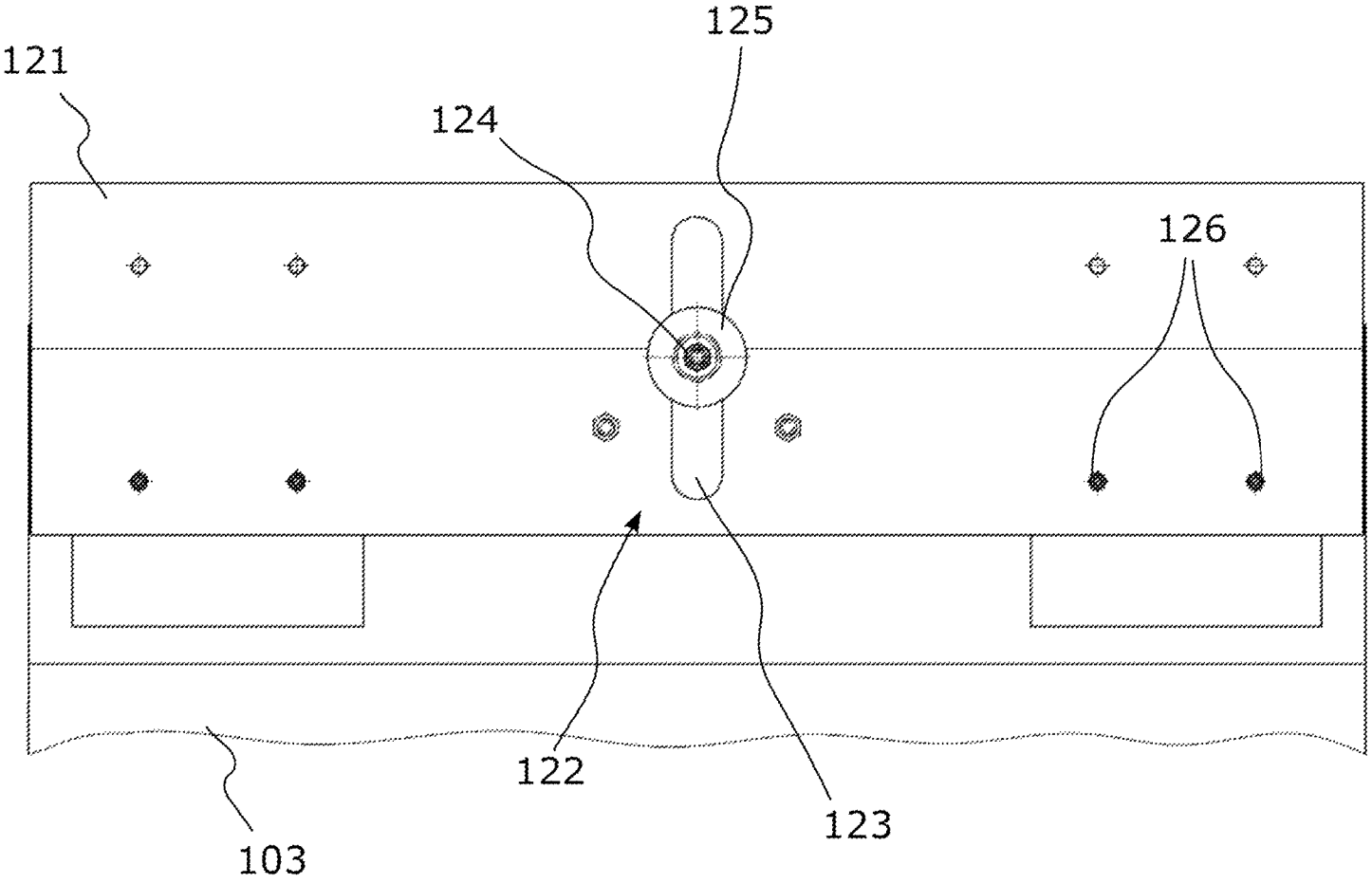
FIG. 7 is a diagrammatic top view of the example float bearing of FIG. 6.

The second lower end 120 of the truss 101 is shown diagrammatically in a perspective view in FIGS. 5 and 6, and in a diagrammatic top view in FIG. 7. In the same way as the first support angle 111, the second support angle 121 may also be fixedly connected to the truss 101 or fastened, for example bolted, thereto.

For the floating bearing 122, the second support angle 121 has a slot 123. The main extension direction of the slot 123 corresponds to the main extension direction of the escalator 100.

A second fixing element 124 in the form of a pin passes through the slot 123. The pin 124 is connected by force fit to the second bearing 103. A second locking element 125 in the form of a disc is fitted, for example screwed, onto the pin 124.

The width of the slot 123 substantially corresponds to the diameter of the pin 124. For example, the width of the slot 123 may be larger by maximum 0.5% than the diameter of the pin 124. The pin 124 can thus easily pass through the slot 123.

In this example, the length of the slot 123 is 140 mm longer than the diameter of the pin 124. Thus a translational movement of the second support angle 121 relative to the second bearing 103 is possible in a range of ±70 mm in the main extension direction of the escalator 100.

The second support angle 121 also lies on elements 126 in the form of threaded bolts which are fixedly connected to the second bearing 103.

The floating bearing 122 allows a translational movement of the second support angle 121 in a range of ±70 mm in the main extension direction of the escalator 100. Furthermore, a rotational movement of the second support angle 121 and hence the truss 101 about the pin 124 is possible.

In the event of a natural disaster, for example an earthquake, forces caused by the natural disaster and acting on the escalator 100 may be compensated within certain limits. Since the escalator 100 is not rigidly fastened to the building, a compression, an extension, or a rotational or shear movement of the building, in particular e.g. of the bearings 102 and 103 relative to each other, is ideally not transmitted to the truss 101. Thus, up to a certain degree of severity of the natural disaster, stresses in the truss 101 from the forces occurring, and the resulting damage, can be prevented. In particular, a breakage of individual beams of the truss 101 can be prevented more effectively than with conventional escalators.

For example, on a natural disaster, the bearings 102 and 103 may move apart or towards each other in the main extension direction of the escalator 100. By the suppression of translational movements of the first support angle 111, in such a case this is "secured" and the escalator 100 executes the similar movement of the first bearing 102. Because of the possible translational movement of the second support angle 121 in the main extension direction, the escalator 100 can move relative to the second bearing 103.

For example, on a natural disaster, the bearings 102 and 103 can also rotate about a common rotation axis or about different rotational axes perpendicular to the main extension direction of the escalator. Due to the possible rotation of the support angles 111 and 121 about the respective pins 114 and 124, in such a case the escalator 100 can rotate in the same way as the bearings 102 and 103 about the corresponding rotation axes perpendicular to the main extension direction.

LIST OF REFERENCE SIGNS

100 Transporting apparatus, escalator
101 Truss

102 First bearing
103 Second bearing
110 First end of truss
111 First support angle
112 Fixed bearing
113 Hole
114 First fixing element, pin
115 First locking element, first disc
116 Threaded bolt
120 Second end of truss
121 Second support angle
122 Floating bearing
123 Slot
124 Second fixing element, pin
125 Second locking element, second disc
126 Threaded bolt

What is claimed is:

1. A transporting apparatus comprising:

a truss with a first end and a second end, wherein a first support angle is disposed at the first end and a second support angle is disposed at the second end;

a fixed bearing by which the first support angle is fitted on a building, wherein the first support angle includes a hole, wherein a first fixing element that is fastened on the building passes through the hole; and a floating bearing by which the second support angle is fitted on the building, wherein the second support angle includes a slot, wherein a second fixing element that is fastened on the building passes through the slot.

2. The transporting apparatus of claim 1 further comprising:

a first locking element disposed on the first fixing element; and a second locking element disposed on the second fixing element.

3. The transporting apparatus of claim 2 wherein at least one of the first locking element or the second locking element is configured as a disc, a nut, a lock ring, or a split pin.

4. The transporting apparatus of claim 2 wherein at least one of:

the first locking element is configured as a first disc, a width of which first disc is greater than a width of the hole of the first support angle, or the second locking element is configured as a second disc, a width of which second disc is greater than a width of the slot of the second support angle.

5. The transporting apparatus of claim 2 wherein the first locking element and the first fixing element form a structural unit, and/or the second locking element and the second fixing element form a structural unit.

6. The transporting apparatus of claim 1 wherein at least one of the first fixing element or the second fixing element is configured as at least one of a pin or a threaded bolt.

7. The transporting apparatus of claim 1 wherein at least one of:

the first fixing element and the second fixing element are substantially cylindrical, or the hole of the first support angle is substantially circular.

8. The transporting apparatus of claim 7 wherein the hole of the first support angle has substantially a same diameter as the first fixing element.

9. The transporting apparatus of claim 7 wherein a width of the slot of the second support angle substantially corresponds to a diameter of the second fixing element.

10. The transporting apparatus of claim 7 wherein a length of the slot of the second support angle is between 100 mm and 350 mm longer than a diameter of the second fixing element.

11. The transporting apparatus of claim 7 wherein a length of the slot of the second support angle is between 140 mm and 280 mm longer than a diameter of the second fixing element.

12. The transporting apparatus of claim 1 wherein the first end of the truss is an upper end of the truss, wherein the second end of the truss is a lower end of the truss.

13. A method for installing a transporting apparatus in a building, the method comprising:

fitting a first support angle, which is disposed at a first end of a truss of the transporting apparatus, on the building via a fixed bearing, wherein a first fixing element is passed through a hole in the first support angle and fastened to the building; and fitting a second support angle, which is disposed at a second end of the truss of the transporting apparatus, on the building via a floating bearing, wherein a second fixing element is passed through a slot in the second support angle and fastened to the building.

14. The method of claim 13 wherein the first end of the truss is an upper end of the truss, wherein the first support angle is fitted on an upper floor of the building via the fixed bearing.

15. The method of claim 14 wherein the second end of the truss is a lower end of the truss, wherein the second support angle is fitted on a lower floor of the building via the floating bearing.

* * * * *